United States Patent [19]

Zebree

[11] 4,056,059

[45] Nov. 1, 1977

[54] CLOSED INITIATOR SYSTEM INCLUDING EXPLOSIVE ENERGY-INITIATABLE BLASTING CAPS, AND METHOD

[75] Inventor: David T. Zebree, Kingston, N.Y.

[73] Assignee: Hercules Incorporated, Wilmington, Del.

[21] Appl. No.: 710,058

[22] Filed: July 30, 1976

[51] Int. Cl.[2] ..... F42B 3/10; F42D 1/04

[52] U.S. Cl. ..... 102/22 R; 102/29

[58] Field of Search ..... 102/22–24, 102/27–29

[56] References Cited

U.S. PATENT DOCUMENTS

| | | | |
|---|---|---|---|
| 3,885,499 | 5/1975 | Hurley | 102/23 |
| 3,895,577 | 7/1975 | Zebree | 102/29 |
| 3,939,772 | 2/1976 | Zebree | 102/22 |

*Primary Examiner*—Verlin R. Pendegrass
*Attorney, Agent, or Firm*—Joshua W. Martin III

[57] ABSTRACT

A closed initiator system for explosives containing one or more non-electrically initiated blasting caps containing an ignition charge ignitable by action of explosive energy of an explosive gas mixture, including means for removal of resident non-explosive gases from the blasting cap(s) to provide space for the explosive gas mixture and subsequent emplacement of the explosive gas in the blasting cap(s) for explosion and responsive ignition of the ignition charge. Means for removal of the resident non-explosive gases include evacuation means and gas displacement means. Method involving initiation of one or more of the blasting caps disposed in gas-tight relationship is also provided.

20 Claims, 20 Drawing Figures

Figure 1:
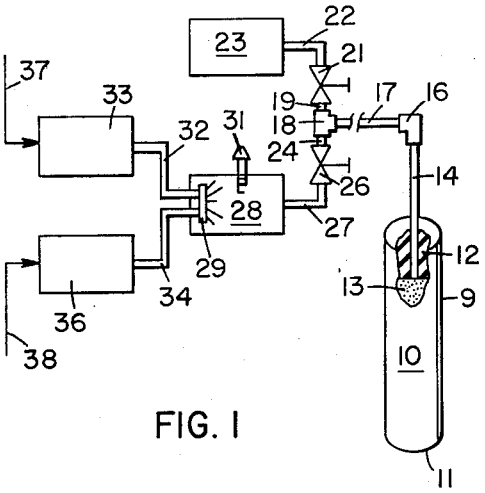

CLOSED INITIATOR SYSTEM INCLUDING EXPLOSIVE ENERGY-INITIATABLE BLASTING CAPS, AND METHOD

This invention relates to a closed system containing one or more blasting caps initiatable by action of explosive energy of an explosive gas mixture. In one aspect, this invention relates to a system above described, including evacuation means, for emplacing the explosive gas mixture for the initiation. In another aspect, this invention relates to a system above described including means for emplacing the explosive gas mixture under pressure conditions in lieu of evacuation means above referred to. In another aspect, this invention relates to a system including evacuation means above described and further including means for enlarging the volume of the system to provide for correspondingly marked reduction in degree of evacuation required. In still another aspect, this invention relates to a method for initiation of explosives by action of one or more blasting caps initiatable as above described. Other aspects are evident in light of the disclosure, the drawings, and the appended claims.

Blasting caps initiatable by action of thermal detonation energy of an explosive gas mixture, and initiation system containing same, and method, are disclosed and claimed in U.S. Pat. No. 3,885,499. The blasting caps are first purged of gas initially present therein by passing a purging stream of an explosive gas mixture therethrough, and the residual explosive purging gas mixture is then ignited for detonation of same and travel of the detonation wave along the path of the explosive gas mixture for subsequent detonation of the blasting cap(s). The system is of necessity open to provide for continuous passage of the purging stream of explosive gas mixture therethrough and hence into the atmosphere.

This invention is concerned with a closed blasting system including one or more blasting caps initiatable by action of explosive energy of an explosive gas mixture, and associated method, in which any possibility of discharge of a stream of the explosive gas into the atmosphere is eliminated.

In accordance with the invention, a closed initiator system, including at least one non-electrically initiatable blasting cap, for the detonation of an explosive, is provided, which comprises:

as said blasting cap(s), (1) a closed shell, (2) an ignition charge in said shell ignitable in response to action of explosive energy of an explosive gas mixture, and (3) conduit means communicating the interior of said shell with the exterior thereof and opening in said shell in operative relationship with said ignition charge therein to convey resident non-explosive gas being removed from said shell and convey an explosive gas mixture as a confined stream from outside said shell into position therein for explosion and responsive ignition of said ignition charge;

separate means outside said shell connecting through said conduit means for (1) removal of at least a portion of resident non-explosive gas from said shell, (2) subsequent emplacement of said explosive gas mixture in said position for explosion of same, and (3) for then igniting said explosive gas mixture when so emplaced; and said conduit means and said shell of said blasting cap(s) disposed in gas-tight relationship with the other and with said means for removal of said non-explosive gas and subsequent emplacement of said explosive gas mixture and said means for igniting said mixture.

In preferred practice, the initiator system of the invention contains a plurality of blasting caps, each generally elongated and closed at one end by a suitable plug closure such as one formed from a plastic or elastomer type material; and the conduit means is a single tube, or pair of tubes, extending through the end plug closure.

The initiator system of the invention, in a now-preferred embodiment includes evacuation means connecting through the conduit means of the blasting cap(s) for removal of the resident non-explosive gas from the blasting cap(s) and means for then delivering the explosive gas mixture through the conduit means into the blasting cap(s) for emplacement and explosion. In another embodiment, the initiator system includes means in lieu of evacuation means for removal of resident non-explosive gas and emplacement of the explosive gas mixture for explosion. In this embodiment, the initiator system contains means for increasing the volume of the system such as by an extra length of tubing forming a closed chamber but opening into the system; and means for passing the explosive gas mixture into the blasting cap(s) under sufficiently high pressure for concomitantly causing compression of the resident non-explosive gas mixture and positive displacement of a suitable proportion of same into the enlarged, or chamber, portion, to provide space for emplacement and explosion of the incoming gas mixture.

In practice of the now preferred embodiment of the invention, in accordance with which the non-explosive gas is removed from the system by evacuation, the degree of evacuation required is dependent upon the proportion of initially present, i.e., resident, inert non-explosive gas that must be removed from the blasting cap to provide it with capacity for containing the incoming explosive gas mixture required for the explosion. Hence, the minimum degree of evacuation depends upon the particular explosive gas composition, and the charging pressure; and by the term "charging pressure" is meant the total gas pressure in the blasting cap after the explosive gas mixture has been charged into emplacement for the explosion.

I have found that when the system is initially under a vacuum in the order of from 20 Lto 25 Hg, the pressure under which the explosive gas can be maintained in emplacement is generally in the order of about one atmosphere; and, under such conditions, the proportion of residual resident non-explosive gas in the system is insufficient to adversely dilute the emplaced explosive gas mixture for the subsequent explosion. In other embodiments, wherein the degree of evacuation is less, such as when the system is under from 5 to 10 Hg vacuum, the proportion of the residual non-explosive gas in the system may be sufficiently great to adversely affect detonatability of the emplaced explosive gas mixture; and, it is often thus required under such conditions that the explosive gas mixture be in emplacement under a somewhat higher pressure, say in the order of 20 to 50 p.s.i.g. to provide the requisite explosive gas mixture for the explosion. In other embodiments, the pressure under which the explosive gas mixture is maintained in emplacement can be less than one atmosphere, albeit such is generally undesired inasmuch as the overall pressure of the system being less than atmospheric, there is some susceptibility to leaks from the atmosphere under those conditions. Generally, it is preferred to evacuate the system to within a range of from about 23 to 29 Hg vacuum and to charge the explosive gas mixture under pressure in the order of from 25 to 50 p.s.i.g. As above described, however, evacuation and emplacement pressures can be outside the above ranges when desired.

I have found that the degree of evacuation normally required can be reduced by increasing the volume of the closed system sufficiently to provide a "chamber" into which a portion of the residual non-explosive gas can be displaced after the evacuation by the in-flowing explosive gas mixture, and inasmuch as suchinvolves expansion of the closed system to a larger volume the "chamber" is also referred to herein as an expansion chamber. Hence, at any given charging pressure, when the closed system includes an expansion chamber, the amount of the explosive gas mixture in the blasting cap is in proportion to the amount of non-explosive gas displaced. For example, when the total volume of the closed system (without an expansion chamber) is in the order of 68 cc., the explosive gas mixture composition (volume percent) is 20 percent methane, 20 percent hydrogen and 60 percent oxygen, and the charging pressure is 40 p.s.i.g., the required degree of evacuation is that providing from about 25 to 26 Hg vacuum and hence a residual pressure of non-explosive gases in the blasting cap in the order of from 3 to 4 Hg; but when the volume of the system is increased to provide an expansion chamber of volume in the order of 37 cc., the degree of required evacuation is in the order of only about 3 Hg vacuum, thus permitting a residual pressure of non-explosive gases in the blasting cap in the order of 26 Hg.

Further in accordance with the invention, a method is provided for initiating one or more non-electric blasting caps for the detonation of a main explosive charge when said blasting cap(s) contains an ignition charge ignitable in response to action of explosive energy of an explosive gas mixture, comprising maintaining said blasting cap(s) in gas-tight relationship as a closed system, removing resident non-explosive gas from said blasting cap(s), thereafter emplacing said explosive gas mixture in said blasting cap(s) in operative communication therein with said ignition charge for explosion and responsive ignition of said ignition charge, and then igniting and concomitantly exploding the emplaced gas mixture.

In carrying out the method of the invention, it is preferred that the system include a plurality of spaced-apart blasting caps, all of which can be emplaced in the same main charge for detonation of same, or in separately disposed main charges such as those emplaced in a plurality of boreholes spaced apart in a predetermined pattern in an earth formation.

Figure 1A:
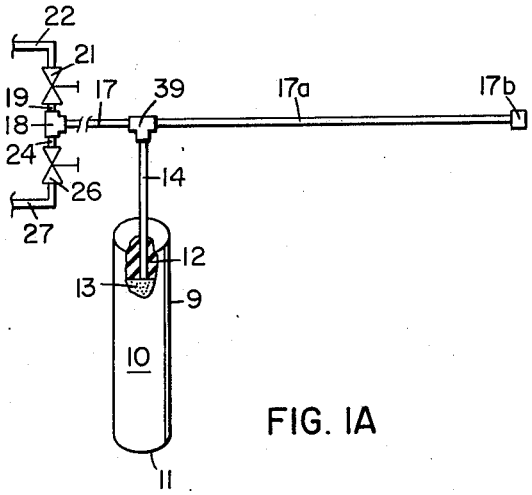
Figure 1B:
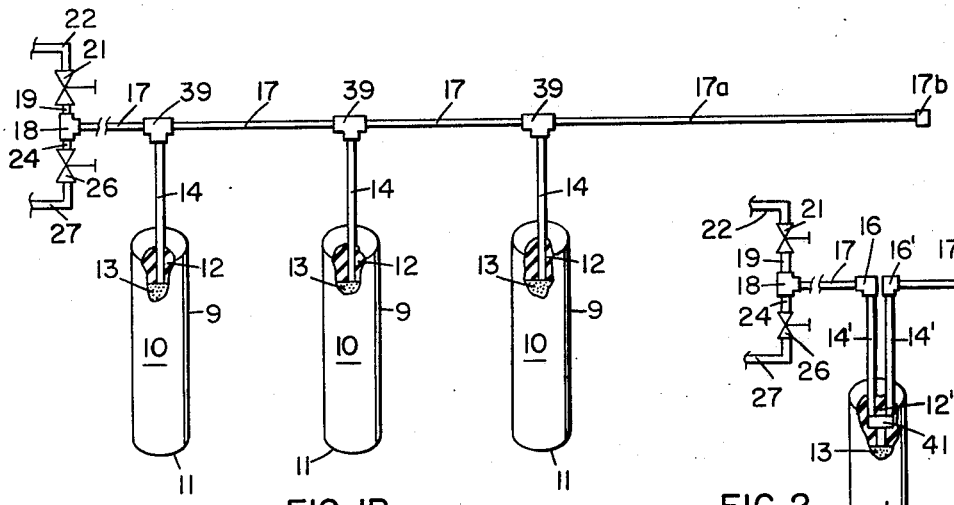
Figure 2:
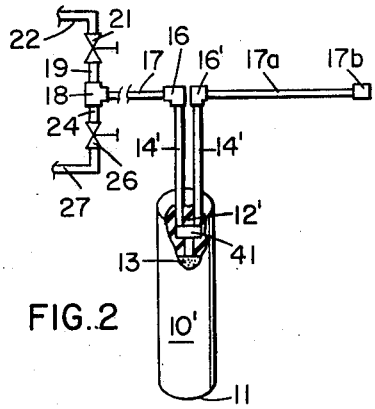
Figure 2A:
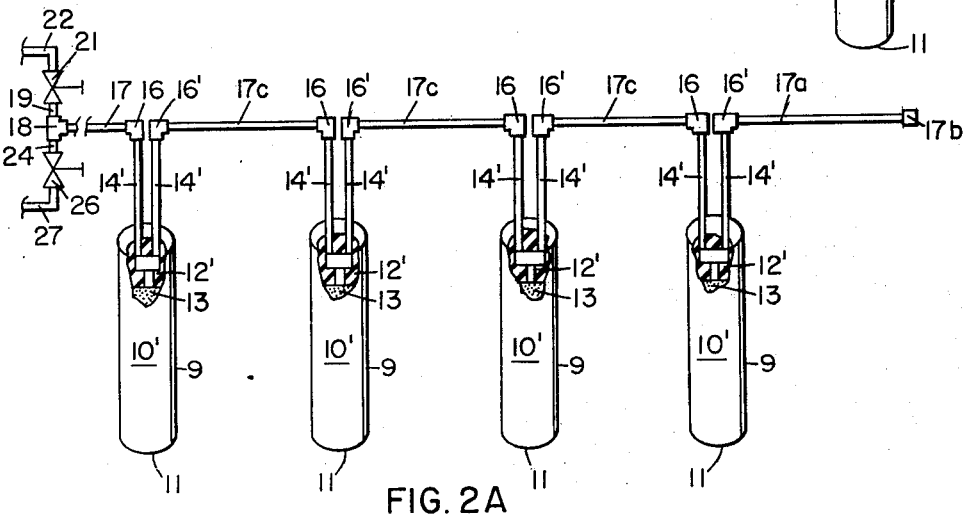
Figure 2B:
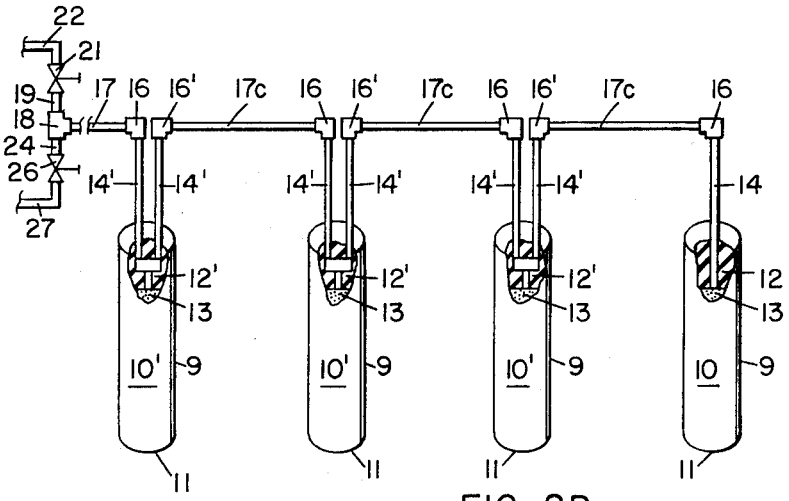
Figure 3:
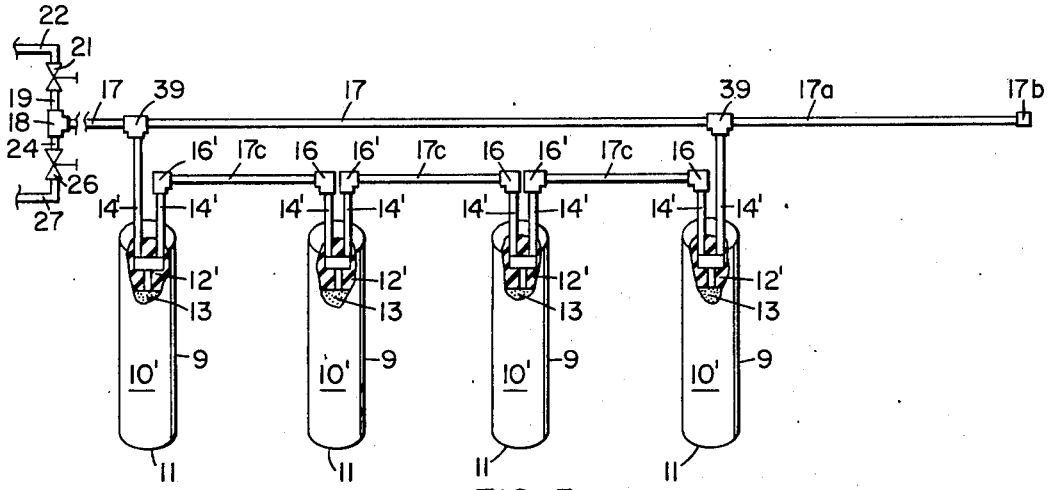
Figure 4:
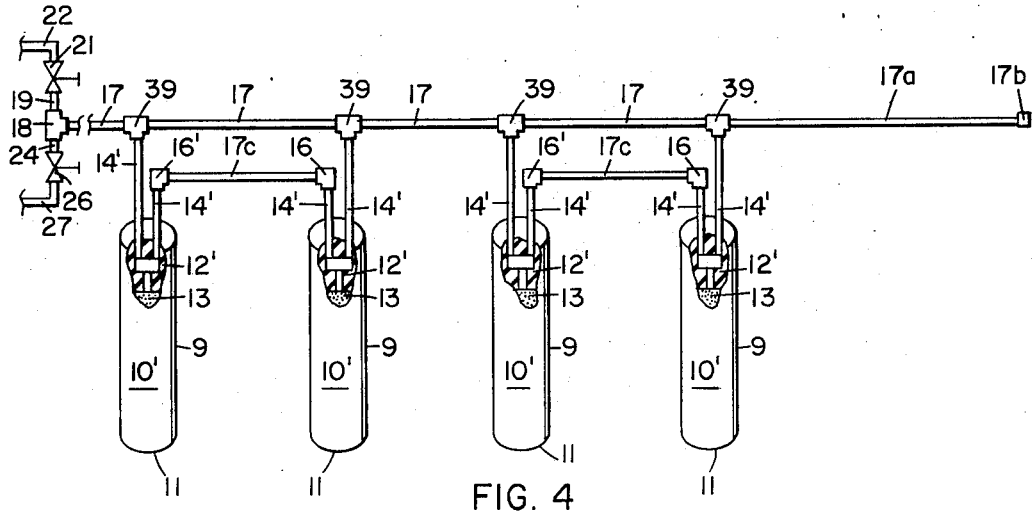
Figure 5:
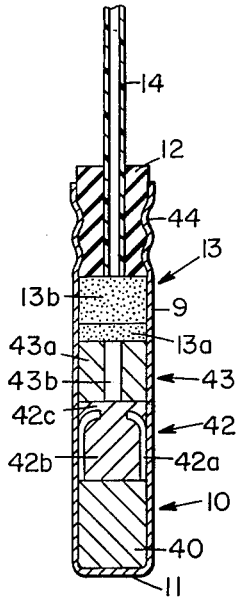
Figure 5A:
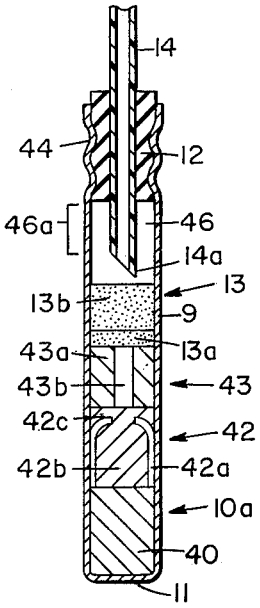
Figure 5B:
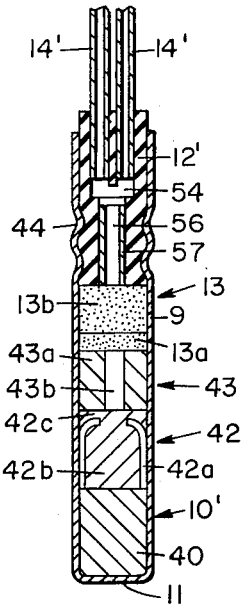
Figure 5F:
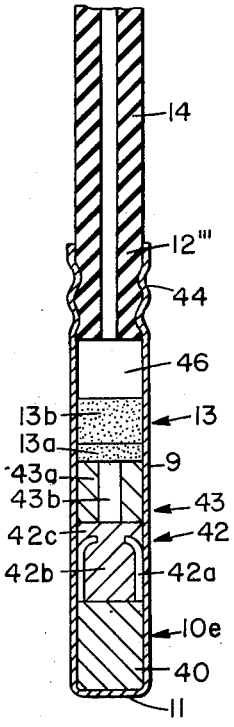
Figures 6, 6A, 6B, 6C:
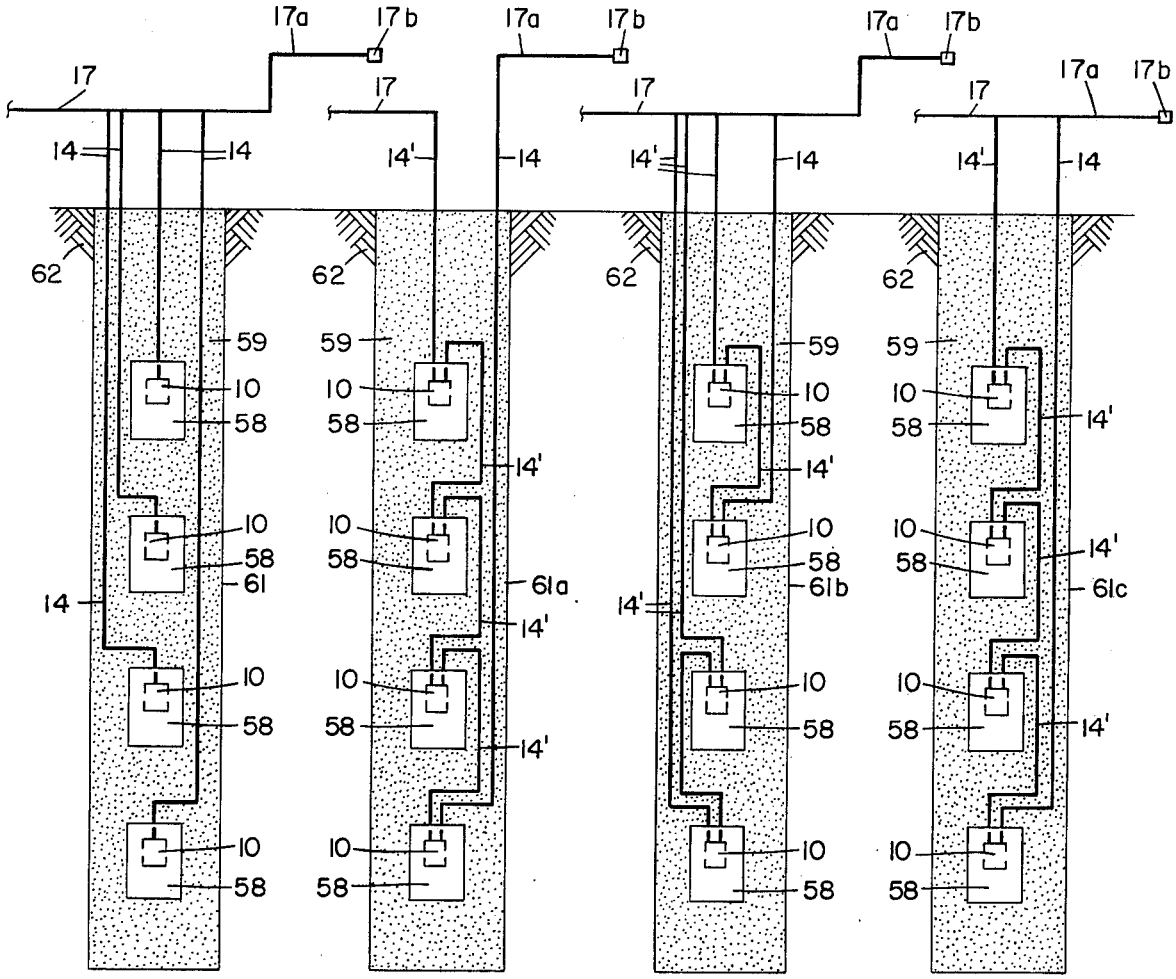
Figure 7:
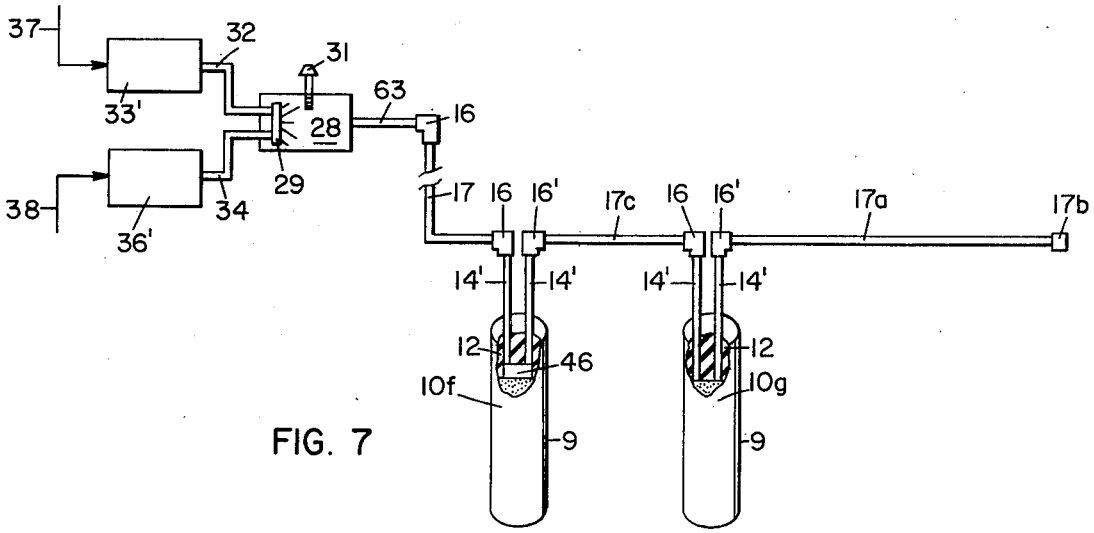

The invention is further illustrated with reference to the drawings of which FIGS. 1–6, incl., illustrate now preferred system and method of the invention involving evacuation for removal of resident non-explosive gases prior to emplacement of the explosive gas mixture for explosion, and FIGS. 5B and 7 illustrate method and system of the invention removal of resident non-explosive gas from the system by means in lieu of the evacuation route. Thus, FIG. 1 illustrates a system containing a blasting cap containing a single conduit in communication with the interior and exterior of the shell, FIG. 1A illustrates the system of FIG. 1 additionally including "expansion chamber" means providing for utilization of a lesser degree of evacuation prior to the explosive gas mixture charging step, and FIG. 1B illustrates a system of FIG. 1A containing a plurality of blasting caps; FIG. 2 illustrates a system containing a blasting cap having a pair of conduits in communication with the shell exterior and interior, together with optional means such as of FIG. 1A providing for a lesser degree of evacuation prior to the explosive gas mixture charging step, FIG. 2A illustrates a system of FIG. 2 containing a plurality of blasting caps, and FIG. 2B illustrates a system containing one or more blasting cap components of FIGS. 1 and 2; FIGS. 3 and 4 each illustrate a system having a plurality of blasting cap components in selected parallel/series circuits; FIGS. 5—5F further illustrate various blasting cap components of the system; FIGS. 6—6C illustrate several optionally different blasting cap circuits in the system of the invention emplaced in detonating relationship with main explosive charge in each of a plurality of spaced-apart boreholes for blasting to produce earth breakage product; and FIG. 7 illustrates system and method, as above referred to. Like numbers in the drawings refer to like parts.

Referring to FIG. 1, elongated shell 9 of blasting cap 10 is integrally closed at bottom end 11 and is closed at the opposite end by plastic closure plug 12; and it contains base and primer charges (not shown) and ignition charge 13. These three charges are substantially contiguous and extend in the order named toward plug closure 12 with ignition charge 13 substantially in contact with closure 12. A delay charge (not shown) is optionally disposed between, and substantially contiguous with, the ignition and primer charges.

A sole conduit 14 extends through plug closure 12 in open communication with the interior and exterior of shell 9, and connects outside shell 9 through L-type connector 16 with exterior trunk line, or conduit, 17, which connects through tee connection 18 via conduit 19, valve 21 and conduit 22 with vacuum pump assembly 23; and also via conduit 24, valve 26 and conduit 27 with explosive gas mixer/igniter chamber 28 which includes mixing nozzle 29 for receiving separate metered streams of fuel and oxidizer gases and discharge of the mixed gas stream for ignition by flame from spark generation means 31 extending into chamber 28. Nozzle 29 connects through conduit 32 with fuel gas metering means 33 and through conduit 34 with oxidizer gas metering means 36, each receiving fuel gas and oxidizer gas from storage via conduit 37 and 38 respectively. Conduit 14 extends into substantially direct contact with ignition charge 13 in shell 9.

In the operation of the system of FIG. 1, resident non-explosive gases, generally air, are evacuated from blasting cap 10 to a predetermined degree by action of a vacuum pump of assembly 23 via valve 21, trunkline 17 and conduit 14. Upon completion of the required evacuation, an explosive gas mixture formed in chamber 28 by mixing separate metered streams of fuel gas and oxidizer gas from lines 32 and 34 through nozzle 29, is charged into lines 17 and 14 and then ignited by spark from spark generation means 31 and the heat and flame front from the resulting explosion passes from chamber 28 through conduit 27, valve 26, trunkline 17 and conduit 14 into contact with ignition charge 13 for responsive ignition of charge 13 and response of the remaining charges in the shell as described more fully herein.

FIG. 1A is the same as FIG. 1 except that it further illustrates the presence of an expansion chamber 17a which is an extension of conduit, or trunkline 17, through tee connector 39 through which conduit 14 connects with trunkline 17 instead of through connector 16.

Thus, in the system of FIG. 1A, when after a partial evacuation step the explosive gas mixture is passed from mixing chamber 28 into the blasting cap 10, a portion of the residual resident gas in trunk conduit 17 upstream from blasting cap 10 is displaced in at least part by the flowing explosive gas mixture directly into chamber 17*a* instead of directly into blasting cap 10, thereby providing for a proportionately greater amount of explosive gas in the gas stream in trunkline 17 to be displaced into blasting cap 10. Expansion chamber 17*a* is closed at its downstream end by any suitable closure member 17*b* therefor. For example, in the embodiment of FIG. 1A utilizing an expansion chamber 17*a* having a volume of about 30 cubic centimeters and a volume of trunk conduit 17 of about 30 cubic centimeters, and utilizing a total gas charge pressure of 50 p.s.i.g., about 12 Hg vacuum is sufficient evacuation; however, in the same system without the expansion chamber 17*a*, i.e., in the embodiment of FIG. 1, the required degree of evacuation is greater, viz. a vacuum in the order of about 25 to 26 Hg is required. The presence of an expansion chamber in an initiator system of this embodiment thus provides for utilization of a lesser degree of evacuation and hence for improved protection against leaks into the system during evacuation FIG. 1B illustrates a system of the invention which is the same as that of FIG. 1A except that it contains a plurality of the blasting caps of FIG. 1A. In the embodiment of FIG. 1B, the volume of expansion chamber 17*a* is somewhat larger than that of chamber 17*a* of FIG. 1A in order to obtain sufficient displacement of residual resident gases from trunkline 17 that otherwise would be displaced into the blasting caps with accompanying undesired reduction of the proportion of the explosive gas mixture therein. For example, for a system of FIG. 1B utilizing from 10 to 20 blasting caps 10, the volume of the expansion chamber 17*a* is in the order of from about 200 to 250 cubic centimeters. The volume of the expansion chamber is dependent upon the volume of the trunkline and conduit lines 14/14', the specific charge pressure and explosive gas mixture composition. Thus, in the embodiment of FIG. 1B, each of conduits 14 connects through a tee connector 39 to directly communicate trunkline 17 in parallel with the interior of each blasting cap 10 for the evacuation and explosive gas mixture emplacement. Each blasting cap 10 of FIG. 1B is, via trunkline 17, first evacuated to the predetermined degree by action of the vacuum pump assembly 23 and then charged with explosive gas mixture flowing from trunkline 17 and chamber 28. By the presence of chamber 17*a*, the requisite degree of evacuation is reduced as above described.

FIG. 2 illustrates a system of the invention which is the same as that of FIG. 1A except that the blasting cap 10' contains a pair of conduits 14' communicating the shell exterior and interior through the plug closure member 12. Blasting cap 10' also differs from blasting cap 10 of FIGS. 1–1B in respect of the cavity 41 therein adjacent the closure plug 12 and the ignition charge 13. Although, as described hereinafter, a cavity 41 structure is advantageously utilized in the blasting cap assemblies of FIGS. 2–2B and elsewhere in the drawings, such is not required. In the blasting cap assembly 10', a space 41 is generally provided adjacent the terminating ends of conduits 14' in shell 9 to provide space for travel of gases from the end of one conduit in shell 9 into the other conduit therein during the evacuation and emplacement steps; however, as disclosed and claimed in the copending application Ser. No. 710,059, filed concurrently herewith, cavity 41 structure can be dispensed with if permeability of the ignition charge 13 is sufficient to permit flow of gas therethrough from either conduit 14' into the other.

As illustrated in FIG. 2A, each of the plurality of blasting caps 10' of FIG. 2 is connected with the other in series so that the upstreammost conduit 14' connects with trunkline 17 and the adjacent conduit 14' connects through a connector 16' with a supplemental external conduit 17*c*, the latter connecting with a first of the conduits 14' in the adjacent blasting cap and the circuit similarly successively continues via the downstream conduits 14' and 17*c* to provide series evacuation of, and emplacement of the explosive gas mixture in, the entire plurality of blasting caps 10'; and the downstreammost conduit 14' connecting through a connector 16' with expansion chamber conduit 17*a*. In the evacuation of a system of FIG. 2A through vacuum system 23, resident non-explosive gases are drawn along a circuit extending from the downstreammost end of expansion chamber 17*a* through the downstreammost blasting cap 10' and through each succeeding blasting cap 10' in series through the entire plurality until the gases reach vacuum chamber 23. Similarly, during the charging operation, explosive gas mixture from chamber 28 is passed via valve 26 and trunkline 17 through the upstreammost conduit 14' of the upstreammost blasting cap 10' and then through the adjacent conduit 14' and supplemental conduit 17*c* through each of the succeeding blasting caps to thus charge the system in series.

As illustrated with reference to FIG. 2B, the plurality of blasting caps utilized need not each be of the same structure, nor, see also FIG. 1, is it required that an expansion chamber be a part of the system. Thus, series evacuation and charging of the upstreammost blasting caps 10' is effected as described with reference of FIG. 2A, and, during evacuation, resident non-explosive gas is drawn from the downstreammost blasting cap 10, via conduits 14/14' and adjacent conduits 17*c* for series flow of evacuating gases through the succeeding blasting caps 10'. Similarly, during charging, the series flow of explosive gas mixture proceeds from trunkline 17 through the upstream blasting caps 10' and through the downstreammost conduit 17*c*, through conduit 14 and into blasting cap 10. As shown with reference to expansion chamber 17*a* of FIG. 1A, an optionally placed expansion chamber (not shown) can extend downstream from blasting cap 10.

FIG. 3 further illustrates the system of the invention including selected combinations of series and parallel circuits for evacuation, and subsequent charging of the explosive gas mixture. Thus, as shown in FIG. 3, the system contains a plurality of blasting caps 10' the upstream and downstreammost conduits 14' of that plurality connecting in series and in parallel with trunkline 17 and the two intermediate blasting caps 10', i.e., the second and the third downstreammost in the plurality connecting in series as illustrated with reference to FIG. 2A.

FIG. 4 further illustrates the option of parallel and series hookups of blasting caps in the system of the invention that can be utilized, and in this embodiment, each of the upstreammost, and the downstreammost, pair of blasting caps 10', operates in parallel and in series with the trunkline 17.

Often preferred systems are those containing blasting cap circuitry of FIGS. 1B, 2A and 3.

Blasting cap components of the system of the invention are further illustrated with reference to FIGS.

5–5F. Referring to FIG. 5, elongated metal shell 9 of blasting cap 10 contains base explosive charge 40 in an end section adjacent closed end 11, primer charge assembly 42 including longitudinally extending open end capsule 42*a* substantially closing shell 9 and diazo dinitrophenol(diazo) 42*b*within capsule 42*a* and higher density diazo 42*c* superposed on capsule 42*a*, delay charge assembly 43 superposed on primer assembly 42 including lead tube 43*a* substantially closing shell 9 and a delay charge as a core 43*b* in tube 43*a*, ignition charge assembly 13 including ignition wafer 13*a* superposed on delay assembly 43 and main ignition charge 13*b* superposed on wafer 13*a*, plastic plug closure member 12 superposed on ignition charge 13*b*, and conduit 14 extending upwardly through closure plug 12 from direct contact with ignition charge 13*b*. Shell 9 is closed around, and in gas-tight relationship with, closure 12 by crimps 44.

The blasting cap component 10*a* of FIG. 5A is the same as that of FIG. 5 except that plug closure 12 is spaced in shell 9 from charge 13*b* of ignition charge assembly 13 to provide open space 46 intermediate plug 12 and ignition charge 13*b* and extension of conduit 14 into space 46 preferably terminating in close proximity to ignition charge 13 and having the terminating end 14*a* in a plane disposed at an acute angle with the conduit 14 axis. The open space 46, and the terminating conduit portion 14*a* therein form a pocket or trap in the space 46 above the terminating end 14*a* of conduit 14, thus providing a chamber 46*a* which serves the same function as the above-described expansion chamber 17*a* of FIG. 1A. Thus, after evacuation of the initiator system to the predetermined degree, flow of explosive gas mixture from the mixer-igniter chamber 28 and trunkline 17 into and through conduit 14 displaces residual resident gas in conduits 17 and 14 into void space 46 as an expansion chamber thus trapping it in part in upper space portion 46*a* so that the volume of residual resident gas displaced into chamber 46*a* is replaced at the charge emplacement pressure with a proportionately large volume of explosive gas mixture to thereby concomitantly increase its amount and hence ignition sensitivity adjacent the ignition charge 13*b*.

Figure 5C:
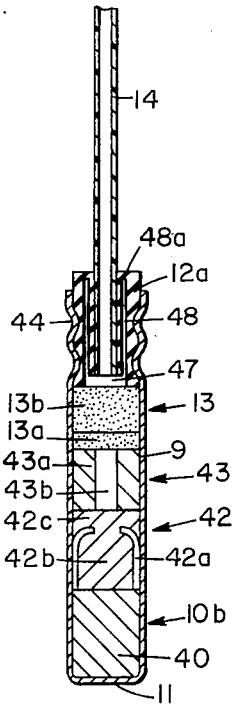

Similarly, each of the blasting cap components of FIGS. 5C, D, E and F is the same as that of FIG. 5 except that it differs from FIG. 5 in respect of the expansion chamber structure. Thus, in blasting cap 10*b* of FIG. 5C, conduit 14 extends into shell 9 and into spaced apart relationship with ignition charge 13*b* to form space 47 which often has a lesser volume than that of space 46 of FIG. 5A, and plug closure 12*a* contains longitudinally extending passageways 48 closed at the upper end 48*a* but opening into space 47. The function of passageways 48 as an expansion chamber is the same as that function of space 46*a* of FIG. 5A.

Figure 5D:
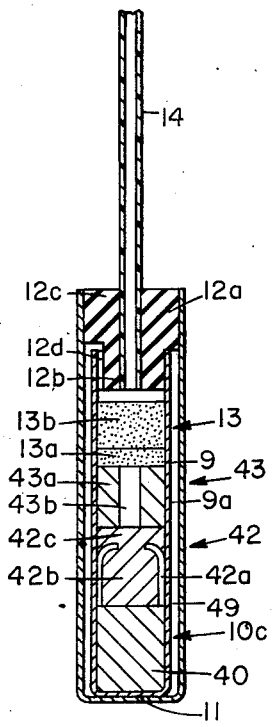

The blasting cap component 10*c* of FIG. 5D includes plastic outer shell 9*a* encompassing shell 9 to provide annular space 49, and ignition plug 12*a* having its forward end 12*b* extending into shell 9 in closing relationship therewith and having offset top end portion 12*c* seated on the top end of shell 9 in closing relationship therewith. Closure plug portion 12*b* contains passageway 12*d* extending upwardly toward portion 12*c* and laterally across the top of shell 9 into open communication with annular space 49, thus communicating conduit 14 with annular space 49 as an expansion chamber having the same function as that of chamber 17*a* of FIG. 1A.

Figure 5E:
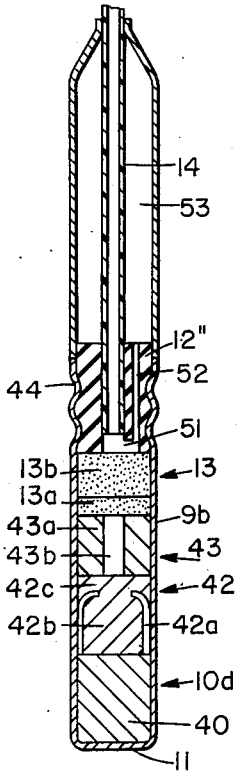

In the blasting cap component 10*d* of FIG. 5E, shell 9*b* is the same as shell 9 except that it extends upwardly from closure 12″ in encompassing and closing relationship with conduit 14 above closure 12″ to provide annular chamber 53. Closure 12″ extends into shell 9*b* into direct contact with ignition charge 13*b* and conduit 14 terminates in closure 12 in spaced apart relationship with ignition charge 13*b* to provide cavity 51 opening into upwardly extending passageway 52 into direct communication with chamber 53.

A blasting cap component 10*e* of FIG. 5F is similar to that of FIG. 5 except that conduit 14 and closure plug 12‴ form an integral closure/conduit unit 12‴/14. In this embodiment, conduit 14 has a thicker wall than that of FIG. 5A and hence can function at explosive gas mixture emplacement pressures higher than generally contemplated when utilizing a conduit 14 having a lesser wall thickness, such as of FIG. 5A.

The blasting cap component 10′ of FIG. 5B is the same as that of FIG. 5 except that a pair of conduits 14′ extend through the closure plug 12′ to communicate the outside of shell 9 with the interior thereof. The closure plug 12′ contains conduits 14′ extending into closure 12′ from the outside thereof into central cavity 54 in closure 12′ and openly communicating through longitudinally extending perforation 56 with ignition charge 13*b* and in contact with charge 13*b*. Perforation 56 contains metal liner 57 to impart support to closure plug 12′ for sustaining the perforation 56 during the crimp operation to form crimps 44. The cavity 54 and perforation 56 directly communicate conduits 14′ with the shell 9 interior and exterior. The entire cap assembly of FIG. 5B is disclosed and claimed in U.S. Pat. No. 3,939,772 and that descriptive portion of U.S. Pat. No. 3,939,772 is incorporated herein by reference.

An initiator system of the invention including a plurality of different blasting cap circuits emplaced in spaced apart boreholes in an earth formation 62 to be blasted is illustrated in FIG. 6. Referring to FIG. 6, four blasting caps 10 of the blasting cap circuit of FIG. 1B are connected with trunk conduit 17 in parallel therewith through their respective conduits 14, and each is separately supported in detonating relationship with a booster charge 58 which are embedded spaced apart in a main explosive charge 59 in borehole 61. In borehole, 61*a*, the blasting cap circuit is that of FIG. 2A herein; in borehole 61*b*, the blasting cap circuit is that of FIG. 4; and the circuit of FIG. 3 is that in borehole 61*c*.

Referring to FIG. 7, elongated shell 9 of each of blasting caps 10*f* and 10*g* is closed at the upper end by plastic end closure plug 12 and contains base and primer charges (not shown), the ignition charge, and, optionally, a delay charge (not shown) intermediate the primer and ignition charges, all charges in contiguous relationship and extending in the order named toward plug 12. Shell 9 of blasting cap 10*f* contains cavity 46 adjacent charge 13 and closure plug 12, with conduits 14′ opening through closure plug 12 into cavity 46 and hence in gas flow communication with the other. In shell 9 of blasting cap 10*g* the conduits 14′ open through closure plug 12 into substantially contiguous contact with ignition charge 13′, which is sufficiently permeable to permit gas flow through its interstices, conduits 14′ thus opening in shell 9 of blasting cap 10*g* in gas flow communication with the other.

The two blasting caps 10*f* and 10*g* are connected in series so that the upstreammost conduit 14′ of blasting cap 10*f* connnects with trunkline 17 through a connector 16 and the adjacent conduit 14' of blasting cap **10*f* connects through a connector 16' with supplemental external conduit 17*c*, the latter connecting with a first of the conduits 14' in the adjacent blasting cap 10*g*; and the in-series circuit similarly successively continuing through additionally and similarly disposed blasting caps, when desired, the downstreammost conduit 14' of the series of FIG. 7 connecting through a connector 16' with tubular expansion chamber 17*a* closed at its downstream end by closure 17*b***.

Trunkline 17 connects the upstreammost conduit 14' of blasting cap **10*f* through connector 16 with discharge conduit 63 of mixing/ignition chamber 28, the latter for mixing and igniting fuel and oxidizer gases separately metered via conduits 32 and 34 into chamber 28 under predetermined elevated pressure conditions. Nozzle 29 in chamber 28 connects through conduit 32 with fuel gas metering and pressurizing means 33' which in turn receives fuel gas from storage via conduit 37, and through conduit 34 with oxidizer gas metering and pressurizing means 36' which in turn receives oxidizer gas from storage via conduit 38**.

In the operation of the system of FIG. 7, resident nonexplosive gases are removed from the system to a predetermined degree by displacement by a stream of incoming explosive gas mixture. Thus, fuel gas from conduit 37 and oxidizer gas from conduit 38 are each respectively placed under a predetermined pressure in chambers 33' and 36' and metered as separate streams via conduits 32 and 34 through nozzle 29 in chamber 28 in proportions for the formation of a detonatable, or deflagratable, fuel/oxidizer gas mixture to be charged into emplacement in blasting caps **10*f* and 10*g* for explosion; and in those proportions and under those predetermined pressure conditions the resulting explosive gas mixture is passed as a single confined stream discharged into trunkline 17**.

The desired degree of displacement of non-explosive gas from the blasting caps **10*f* and 10*g*, i.e., without prior evacuation of the system, is accomplished by passing the displacing gas mixture from conduit 17 under sufficient pressure for compressing the resident non-explosive gas along the in-series path through blasting caps 10*f* and 10*g*, and then into closed expansion chamber tube 17*a*. The required degree of pressurization of explosive gas mixture in chamber 28 is determined by a correlation of the volume of the flow system, i.e., of conduits 63 and 17, and 14' in each of the blasting caps, and cavity 46 of blasting cap 10*f* with the volume of the expansion chamber 17*a*. By way of further illustration, the explosive gas mixture is passed into the flow system of FIG. 7** under conditions providing a final charging pressure in the order of 30–200 p.s.i.g. when the gas flow volume of the system is about 48 cc. and the expansion chamber volume is about 52 cc., about 75 percent of the resident non-explosive gas in the flow system having been displaced, and hence replaced by the explosive gas mixture, under such conditions.

It is to be understood that the initiator system of the invention can include any suitable blasting cap circuit or combination thereof, and any suitable number of blasting caps often from 10 to 50 blasting caps and more, generally with optional expansion chamber means, when removing resident non-explosive gases by evacuation.

By the term "explosive energy" it is meant heat and flame produced by the detonation, or deflagration, of the explosive gas mixture.

Although the invention is specifically illustrated with reference to blasting caps containing a delay fuse, non-delay blasting caps utilizing an ignition charge in combination with at least one additional charge operatively responsive to ignition of the ignition charge can be utilized, albeit in most instances delay type blasting caps constitute the initiator system utilized, and particularly so when the system is operated in a plurality of boreholes as illustrated with reference to FIG. 6. In other embodiments, the blasting cap(s) component can be an initiator such as of the squib type, containing the ignition charge as the only charge.

Although any suitable explosive gas mixture can be utilized in practice of the invention, those which are detonatable and have relatively high detonation rates, such as at least about 2000 meters per second are often advantageously utilized, and when a spark generating system such as illustrated with reference to FIG. 1 is utilized, the preferred explosive gas mixture is one which yields carbon monoxide and carbon dioxide upon detonation to aid in sweeping water from the mixing and ignition system which would otherwise cause corrosion of the spark generation element. Accordingly, although any suitable organic fuel gas/oxygen/hydrogen can be utilized, preferred explosive gas mixtures include manufactured gas Type B/oxygen, and oxygen/methane/hydrogen, mixtures.

Any suitable base charge 40 can be utilized in the blasting cap components of the system such as PETN, RDX, tetryl, or the like. Exemplary of primer assemblies are diazo dinitrophenol/potassium chlorate, lead azide and mercury fulminate, and the like. Ignition charges utilized without a wafer charge are those generally utilized in an ignition/primer/base charge blasting cap assembly with or without a delay charge intermediate the ignition and primer charges, and ignitable in response to action of thermal detonation energy of an explosive gas mixture, illustrative of which are lead-selenium, lead-tin/selenium, tin/selenium, red lead/boron, and red lead/manganese boride. A preferred ignition charge is such as assembly **13*a* of the drawings including a main ignition charge 13*c*, such as lead/-selenium/potassium perchlorate/aluminum/snow floss, 68.4/26.6/2.3/1.2/1.5 and a wafer charge 13*a*, such as ferric oxide/aluminum/boron/lead/selenium/snow floss, 10.0/8.0/1.7/56.2/21.5/2.6. The charge assembly 13 is described in more detail in the disclosure of U.S. Pat. No. 3,939,772, and that portion of U.S. Pat. No. 3,939,772 is incorporated herein by reference. Any suitable delay charge assembly 43 can be utilized such as the core charge 43*b*** in a lead tube, exemplary of which are barium peroxide/selenium, barium peroxide/tellurium and barium peroxide/selenium-tellurium.

Exemplary of main explosive charges 59 are aqueous gel-type explosives, dynamites, prills/fuel oil or the like. Dependent upon whether a main explosive charge is reliably cap-sensitive, a booster charge(s) may not be required, in which event one or more of the blasting caps are embedded directly in the main charge for the detonation.

The conduit means communicating the blasting cap interior and exterior, and generally the conduit(s) constituting the trunkline and expansion chambers and the like are advantageously plastic tubes, for example, 0.103 inch o.d. by 0.060 inch i.d. formed from polyethylene. However, in some embodiments dependent upon the charging pressure, i.e., the requisite pressure for emplacement of the explosive gas mixture, these conduits, although generally plastic, are characterized by greater wall thickness, for example, in the order of 0.06 and greater. External expansion chambers such as those shown in FIGS. 1A, 1B, 2, 2A, 3, 4, and 7, can be of any convenient shape. They may be made from metal, plastic, rubber, and the like.

Suitable connector means for connecting various conduits in the initiator system are generally characterized by a rigid outer surface and a suitably resilient inner layer which when engaged with the abutting tube ends is sufficiently pliable to frictionally support them in place.

When referring to the system in connection with means for removal of resident non-explosive gases and emplacement of the explosive gas mixture as described herein, it is meant that open portion of the system through which there can be gas flow.

The invention is illustrated with reference to the following examples

EXAMPLE 1

A single blasting cap of FIG. 5B was connected through one of the conduits 14', and a trunkline, with a supply of an explosive gas mixture and through the other conduit with a closed tubular expansion chamber. The explosive gas mixture was $O_2/H_2/CH_4$, 60/20/20 (volume basis). The blasting cap contained 0.40 gram of PETN base charge 40, 0.24 gram and 0.06 gram of diazodinitrophenol primer charge **42*b* and 42*c* respectively, 1.0 gram of barium peroxide/selenium, tellurium 40/40,20 delay charge 43*b*, 0.20 gram of ferric oxide/aluminum/boron/Pb/Se/snow floss 10.0/8.0/1.7/56.2/21.5/2.6 as ignition, or wafer, charge 13*a* and 0.45 gram of Pb/Se/$KC10_4$/Al/snow floss 68.4/26.6/2.3/1.2/1.5 as ignition charge 13*b*. The total length of the trunkline and conduit 14' connecting with the blasting cap was 124 ft. The length of the expansion chamber and conduit 14' was 36 ft. Without evacuation, the explosive gas mixture was charged through the trunkline and into the blasting cap at a charging pressure of 32 p.s.i. The trunkline and conduit 14' connecting therewith were formed from low density polyethylene and each had an o.d. of 0.103 inch and a wall thickness of 0.021 inch. Upon emplacement of the explosive gas mixture at the charging pressure, the explosive gas mixture was ignited by spark initiated in direct communication with the explosive gas mixture in the trunkline. The detonation front moved through the trunkline and conduit 14' connecting therewith into ignition relationship with the ignition change 13*b*,** with concomitant subsequent detonation of the base charge.

The above test was repeated except that the expansion chamber was 24 ft. in length. The shot failed. This example demonstrates the system of the invention without evacuation means, and the need for correlation of expansion chamber volume with the remaining volume of gas flow in the system.

EXAMPLE 2

An initiator system illustrated with reference to FIG. 4 of the drawings, including evacuation means for removal of resident non-explosive gas from the blasting cap was assembled and fired in a series of three tests. In each test, the trunkline was connected at its upstream end with evacuation means and with a supply of explosive gas mixture, and a plurality of pairs of blasting caps were connected in series/parallel with the trunkline as shown in FIG. 4. Each blasting cap of the system tested was that of FIG. 5B of the drawings and was the same as that of the tests of Example 1 above. The trunkline 17 was 100 ft. in length and was formed from low density polyethylene having an i.d. of 0.060 in. and a wall thickness of 0.021 in. The explosive gas mixture was $O_2/H_2/CH_4$, 60/20/20. The system tested did not include an expansion chamber **17*a*.** The following summarizes the results of the tests.

| Test | Number of Blasting Caps | Evacuation, Inches Hg Vacuum | Charging Pressure, p.s.i. | Results |
|---|---|---|---|---|
| 1 | 10 | 25 | 40 | All caps detonated |
| 2 | 20 | 20 | 40 | " |
| 3 | 40 | 18 | 40 | " |

As will be evident to those skilled in the art, various modifications can be made or followed, in light of the foregoing disclosure and discussion, without departing from the spirit or scope of the disclosure or from the scope of the claims.

What I claim and desire to protect by Letters Patent is:

1. A closed initiator system including at least one non-electrically initiatable blasting cap, which comprises:

as said blasting cap(s), (1) a closed shell, (2) an ignition charge in said shell ignitable in response to action of explosive energy of an explosive gas mixture, and (3) conduit means communicating the interior of said shell with the exterior thereof and opening in said shell in operative relationship with said ignition charge therein to convey resident non-explosive gas being removed from said shell and convey an explosive gas mixture as a confined stream from outside said shell into position therein for explosion and responsive ignition of said ignition charge;

separate means outside said shell connecting through said conduit means for (1) removal of at least a portion of resident non-explosive gas from said shell, (2) subsequent emplacement of said explosive gas mixture in said position for explosion of same, and (3) for then igniting said explosive gas mixture when so emplaced; and said conduit means and said shell of said blasting cap(s) disposed in gas-tight relationship with the other and with said means for removal of said non-explosive gas and subsequent emplacement of said explosive gas mixture and said means for igniting said mixture.

2. In an initiator system of claim 1 said conduit means comprising a pair of conduits, and said conduits opening in said shell in gas flow communication therein; said means outside said shell for removal of said non-explosive gas and subsequent emplacement of said explosive gas mixture comprising means connecting with one of said pair of conduits for delivery of said explosive gas mixture therethrough under superatomospheric pressure as said confined stream with concomitant displacement of said non-explosive gas through the other conduit; and a closed chamber opening into said conduit means.

3. In an initiator system of claim 1, said means outside said shell for removing said non-explosive gas and subsequent emplacement comprising means connecting through said conduit means for evacuation of a predetermined portion of resident non-explosive gas from said shell, and then for delivering an explosive gas mixture therethrough as said confined stream into said position for explosion.

4. An initiator system of claim 3 containing a plurality of said blasting caps, and each said shell having a plug closure therefor and containing base, primer and said ignition charge with or without a delay charge intermediate said primer and said ignition charges extending in that order toward said plug closure; and each said conduit means communicating said shell interior and exterior through said plug closure.

5. In a system of claim 4, at least one of said plug closures containing a sole conduit extending therethrough as said conduit means.

6. In an initiator system of claim 4, at least one of said plug closures containing a pair of conduits extending therethrough as said conduit means.

7. In an initiator system of claim 4, said plurality including a pair of said blasting caps, each containing corresponding first and second conduits as said conduit means and said first conduit of a first of said pair of blasting caps operatively connecting with said evacuation means and with said explosive gas mixture emplacement means, and said first conduit of the second of said pair of blasting caps connecting with said second conduit of said first blasting cap to thereby dispose said pair of blasting caps in series for evacuation and for receiving series flow of said explosive gas mixture.

8. In an initiator system of claim 5, a conduit external to said plurality of blasting directly connecting in closed relationship with said evacuation means and with said explosive gas mixture emplacement means, and at least one said sole conduit directly connecting with said external conduit.

9. In an initiator system of claim 6, a conduit external to said plurality of blasting caps and directly connecting in closed relationship with said evacuation means and with said explosive gas emplacement means, and at least one conduit of at least one said pair of conduits connecting with said evacuation means and said explosive gas mixture emplacement means through said external conduit.

10. In a system of claim 7, a conduit external to said pair of blasting caps and directly connecting in closed relationship with said evacuation means and with said explosive gas mixture emplacement means, and said first conduit of the first of said pair of blasting caps and said second conduit of said second of said blasting caps directly connecting with said external conduit.

11. In an initiator system of claim 4, a conduit external to said plurality of blasting caps connecting directly with said evacuation and explosive gas mixture replacement means in closed relationship therewith; first and second conduits extending through said closure plug of one of said plurality of blasting caps as said conduit means therefor, and a sole conduit extending through said closure plug of another of said plurality of blasting caps as said conduit means therefor; and each said conduit means of said plurality operatively connecting with said evacuation and explosive gas mixture emplacement means through said external conduit.

12. In a system of claim 4, a conduit external to said plurality of blasting caps and connecting in closed relationship with said evacuation means and with said gas delivery means, valve means operatively connecting at an inlet end thereof with said evacuation and explosive gas mixture emplacement means and at a discharge end with said external conduit.

13. In an initiator system of claim 12, first and second conduits as said conduit means of one of said blasting caps, and said first conduit connecting with said external conduit; and a sole conduit as said conduit means of another of said plurality of blasting caps connecting with said external conduit.

14. In an initiator system of claim 4, a closed chamber opening into gas-tight relationship with said plurality of conduit means.

15. In an initiator system of claim 14, the downstreammost blasting cap of said system containing first and second conduits as said conduit means, and said first conduit thereof operatively connecting with said evacuation means and with said explosive gas delivery means, and said chamber comprising a conduit connecting in series with the second conduit of said downstreammost blasting cap.

16. A method for initiating one or more non-electric blasting caps for detonation of a main explosive charge, when the blasting cap(s) contains an ignition charge ignitable in response to action of explosive energy of an explosive gas mixture, comprising maintaining said blasting cap(s) in gas-tight relationship as a closed system, removing resident non-explosive gas from said blasting cap(s), thereafter emplacing said explosive gas mixture in said blasting cap(s) in operative communication therein with said ignition charge for explosion and responsive ignition of said ignition charge, and then igniting, and concomitantly exploding, the emplaced explosive gas mixture.

17. In a method of claim 16, increasing the volume of said closed system prior to removing said resident non-explosive gas from said blasting cap(s) by opening a closed chamber into communication with said blasting cap(s) downstream therefrom, thereafter removing said resident non-explosive gas by passing a confined stream of said explosive gas mixture at a predetermined elevated pressure in displacement contact therewith, and retaining said explosive gas mixture in said displacing relationship and igniting same for explosion and responsive ignition of said ignition charge.

18. A method for initiating one or more non-electric blasting caps for detonation of a main explosive charge, when the blasting cap(s) contains an ignition charge ignitable in response to action of explosive energy of an explosive gas mixture, comprising maintaining said blasting cap(s) in a closed system, evacuating at least a portion of the resident non-explosive gas from the blasting cap(s) to increase capacity of some for containing said explosive gas mixture, thereafter passing said explosive gas mixture into said blasting cap(s) into operative communication with said initiator charge for explosion and responsive ignition of said ignition charge, and then igniting said explosive gas mixture.

19. A non-electrically initiated blasting cap assembly including a plurality of non-electrically initiated blasting caps, each said blasting cap comprising (1) a closed shell, (2) an ignition charge in said shell ignitable in response to action of thermal detonation energy of an explosive gas mixture, (3) conduit means operatively extending into said shell so as to convey an explosive gas mixture into detonating position therein for responsive ignition of said ignition charge;

gas evacuation means connecting outside each said shell with said conduit means for evacuation of initially present non-explosive gas from said blasting cap, prior to delivery of said explosive gas mixture into said shell;

means for passing an explosive gas mixture from outside each said shell into and through said conduit means into said detonating position in said shell after said evacuation;

each said conduit means communicating in gas-tight relationship with the other with each said shell, said evacuation means and said explosive gas delivery means; and means for igniting said explosive gas mixture for detonation of same when contained in said conduit means.

20. A system of claim 19, including a tubular member downstream as an expansion chamber for increasing the volume of said system sufficiently to provide for a corresponding reduction in the degree of evacuation of said system required for emplacement of a detonatable porportion of said explosive gas mixture in each said blasting cap.

* * * * *